US012331489B2

(12) United States Patent
Shiwaku et al.

(10) Patent No.: US 12,331,489 B2
(45) Date of Patent: Jun. 17, 2025

(54) WORK MACHINE AND CONTROL SYSTEM FOR WORK MACHINE

(71) Applicant: HITACHI CONSTRUCTION MACHINERY CO., LTD., Tokyo (JP)

(72) Inventors: Koji Shiwaku, Ibaraki (JP); Shinya Imura, Ibaraki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 17/907,777

(22) PCT Filed: Mar. 31, 2021

(86) PCT No.: PCT/JP2021/013842
§ 371 (c)(1),
(2) Date: Aug. 29, 2022

(87) PCT Pub. No.: WO2022/208725
PCT Pub. Date: Oct. 6, 2022

(65) Prior Publication Data

US 2023/0358024 A1 Nov. 9, 2023

(51) Int. Cl.

| | |
|---|---|
| ***E02F 9/20*** | (2006.01) |
| ***E02F 9/26*** | (2006.01) |
| *E02F 9/22* | (2006.01) |

(52) U.S. Cl.
CPC ..... *E02F 9/262* (2013.01); *E02F 9/2033* (2013.01); *E02F 9/2203* (2013.01); *E02F 9/2285* (2013.01); *E02F 9/2296* (2013.01)

(58) Field of Classification Search
CPC ..... E02F 9/262; E02F 9/2033; E02F 9/2203; E02F 9/2285; E02F 9/2296
(Continued)

(56) References Cited

U.S. PATENT DOCUMENTS

| | | | | |
|---|---|---|---|---|
| 2020/0232188 | A1 | 7/2020 | Chiba et al. | |
| 2021/0002859 | A1* | 1/2021 | Wu | G08G 1/166 |
| 2022/0106769 | A1* | 4/2022 | Takaoka | E02F 3/841 |

FOREIGN PATENT DOCUMENTS

| | | |
|---|---|---|
| JP | 08-27841 A | 1/1996 |
| JP | 09-71965 A | 3/1997 |

(Continued)

OTHER PUBLICATIONS

Chinese Office Action received in corresponding Chinese Application No. 202180017591.1 dated Feb. 19, 2025.

*Primary Examiner* — Mahmoud S Ismail
(74) *Attorney, Agent, or Firm* — MATTINGLY & MALUR, PC

(57) ABSTRACT

Provided is a work machine and a control system for the work machine capable of preventing reduction of a work efficiency when inputting a complicated work area. The work machine includes a work area setting device 501, a work machine position/attitude acquisition device 502 and a work device position/attitude acquisition device 503, a controller 500, and a designated area setting device 504. When a hydraulic excavator (work machine) 1 intrudes on a designated area 401, the controller 500 puts operation restriction control in a work area 111 to an enabled state or disabled state according to an enable or disable setting of the operation restriction control depending on the designated area 401 set in the designated area setting device 504.

6 Claims, 16 Drawing Sheets

(58) Field of Classification Search
USPC ..... 701/50
See application file for complete search history.

(56) References Cited

FOREIGN PATENT DOCUMENTS

| | | | |
|---|---|---|---|
| JP | 2008-286300 | A | 11/2008 |
| JP | 2011-052383 | A | 3/2011 |
| JP | 2013-159421 | A | 8/2013 |
| JP | 6687993 | B2 | 4/2020 |
| JP | 2021-31922 | A | 3/2021 |
| WO | 2019/181874 | A1 | 9/2019 |

* cited by examiner

WORK MACHINE AND CONTROL SYSTEM FOR WORK MACHINE

TECHNICAL FIELD

The present invention relates to a work machine and a control system for the work machine.

BACKGROUND ART

In order to improve work efficiency or increase safety of work machines, such as hydraulic excavators, there is proposed a work machine that puts restrictions on actuator operation in a designated space (hereinafter referred to as a work area) within a worksite.

For example, a turnable work machine described in Patent Literature 1, 2 calculates its current attitude, and when there is a possibility that any of work devices, such as a structure of a boom, an arm, a bucket, for example, will enter the outside of any given area set in advance, controls the turning movement to stop.

CITATION LIST

Patent Literature

Patent Literature 1: JP 2011-52383 A
Patent Literature 2: JP 2013-159421 A

SUMMARY OF INVENTION

Technical Problem

However, the techniques of the above Patent Literature 1, 2 both assume only a simple surface and operation range of the work machine. In a worksite in which a complicated work area is required, the work efficiency may be reduced when setting a work area and when enabling/disabling the work area. Specifically, when taking a long time, in a work area, to input a work area or when inputting an enable/disable setting in the work area, for example, interference with a path or work of another work machine may occur, for example.

The present invention has been made in view of the foregoing, and provides a work machine and a control system for the work machine capable of preventing reduction of a work efficiency when inputting a complicated work area.

Solution to Problem

To solve the above problem, a work machine of the present invention includes: a work area setting device adapted to set a work area for performing operation restriction control of a work machine; an acquisition device adapted to acquire at least one of a position or an attitude of the work machine; a controller adapted to switch between an enabled state, in which the operation restriction control of the work machine in the work area is enabled, and a disabled state, in which the operation restriction control of the work machine in the work area is disabled, and, when the operation restriction control is switched to the enabled state, perform the operation restriction control of the work machine in the work area; and a designated area setting device adapted to set any given designated area in a worksite and an enable or disable setting of the operation restriction control in the work area depending on the designated area.

When the work machine intrudes on the designated area, the controller puts the operation restriction control in the work area to an enabled state or disabled state according to the enable or disable setting of the operation restriction control depending on the designated area set in the designated area setting device.

Advantageous Effects of Invention

According to the present invention, it is possible to make work area settings regardless of whether the work machine is inside or outside of the work area, and prevent the work machine from being stopped within the work area, thus improving the work efficiency.

Other problems, configurations, and advantageous effects will become apparent from the following description of embodiments.

DESCRIPTION OF EMBODIMENTS

Hereinafter, embodiments of the present invention will be described with reference to the drawings. Parts having the same function are denoted by the same reference numbers throughout the drawings, and repeated description thereof may be omitted. In the following description, the work machine according to the embodiments of the present invention is a hydraulic excavator as an example. It should be noted that the work machine to which the present invention is applicable may be a work machine including a work device and a moving device other than the hydraulic excavator, such as a wheel loader, a road roller, a dump truck, a bulldozer, for example, and the aspect thereof does not matter.

First Embodiment (Overall Configurations)

Figure 1:
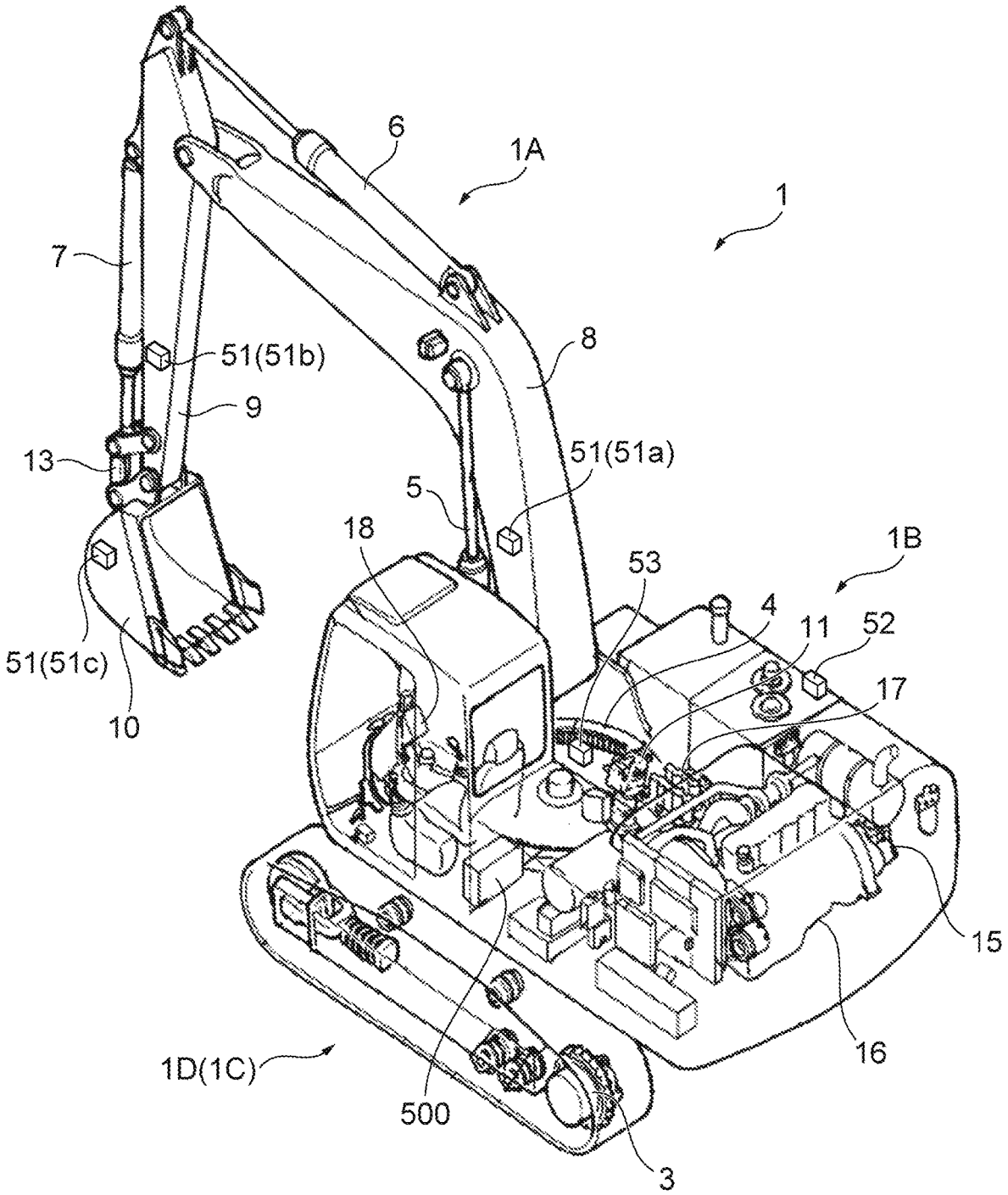
FIG. 1 is a perspective view of an example of a work machine according to a first embodiment of the present invention.

FIG. 1 is a perspective view of a hydraulic excavator that is an example of a work machine having a control system mounted thereon according to the first embodiment of the present invention.

A hydraulic excavator 1 includes a lower traveling body 1C, an upper turning body 1B rotatably attached to the lower traveling body 1C via a turning device 4, and a work device 1A that is attached to the upper turning body 1B and performs digging work, loading work, and the like. The lower traveling body 1C and the upper turning body 1B constitute a moving device 1D (hereinafter also referred to as a body) that performs traveling operation and turning operation in the present embodiment.

The work device 1A includes a boom 8 rotatably attached to the upper turning body 1B, an arm 9 rotatably attached to the boom 8, a bucket 10 rotatably attached to the arm 9, a bucket link 13 rotatably attached to the bucket 10 and the arm 9, a boom cylinder 5 that is coupled to the boom 8 and the upper turning body 1B and arbitrarily changes a rotation angle of the boom 8 relative to the upper turning body 1B, an arm cylinder 6 that is coupled to the boom 8 and the arm 9 and arbitrarily changes a rotation angle of the arm 9 relative to the boom 8, and a bucket cylinder 7 that is coupled to the arm 9 and the bucket link 13 and arbitrarily changes a rotation angle of the bucket 10 relative to the arm 9.

The lower traveling body 1C is driven by a travel motor 3 and allows the body to move to any given position. The turning device 4 includes a turning motor 11 that arbitrarily changes a rotation angle (i.e., a turning angle) of the upper turning body 1B relative to the lower traveling body 1C. Hereinafter, the boom cylinder 5, the arm cylinder 6, and the bucket cylinder 7 for driving the work device 1A, the travel motor 3 for traveling operation, and the turning motor 11 for turning operation may each be referred to as an actuator of the hydraulic excavator 1.

In the upper turning body 1B, a tank 14 (FIG. 2), a variable pump 15, an engine (prime mover) 16, a flow rate control valve (unit) 17, an interface 18, a controller 500, and the like are disposed. Though not illustrated, the controller 500 is configured as a computer including a CPU (Central Processing Unit) that executes various operations, a storage unit such as a ROM (Read Only Memory), a HDD (Hard Disk Drive), or the like that stores programs for executing the operations by the CPU, a RAM (Random Access Memory) serving as a work area when the CPU executes the programs, and the like. The CPU loads various programs stored in the storage unit into the RAM and executes the programs so that the functions of the controller 500 are implemented.

The interface 18 is used for inputting a work area and a designated area, and an enable/disable setting of the work area depending on the designated area (described later). It should be noted that a work area, a designated area, and the like may be set by an operator or a worker around the hydraulic excavator, for example, and the aspect of inputting does not matter. In the present embodiment, a work area, a designated area, and the like are input/set via the interface 18 disposed in the upper turning body 1B (e.g., cab). However, a work area, a designated area, and the like may be input/set from the outside of the body via a server, for example.

Figure 4:
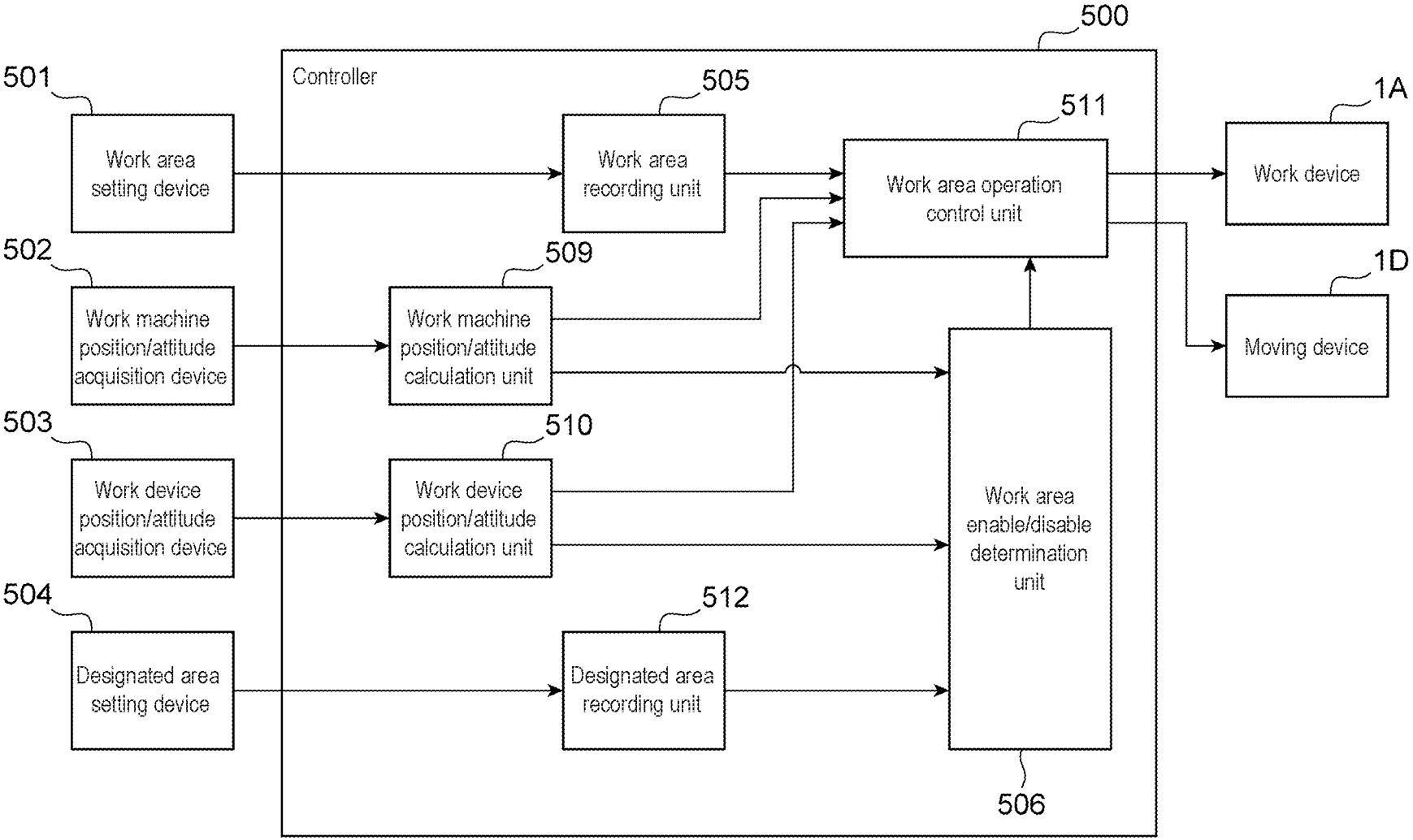
FIG. 4 is a system configuration diagram according to the first embodiment of the present invention.

That is, the interface 18 constitutes a work area setting device 501 adapted to input/set a work area and a designated area setting device 504 adapted to input/set a designated area and an enable/disable setting of the work area depending on the designated area in the present control system (FIG. 4).

The hydraulic excavator 1 includes, as sensors, IMUs 51*a*, 51*b*, 51*c* (hereinafter the IMUs 51*a*, 51*b*, 51*c* are collectively referred to as a work implement IMU 51) respectively provided for the boom 8, the arm 9, and the bucket 10 for measuring ground angles of link joints, an upper turning body IMU 53 provided on the upper turning body 1B for measuring a ground angle of the upper turning body 1B, and a GNSS 52 for measuring global coordinates of the upper turning body 1B. Based on the result of measurement by the GNSS 52 and the upper turning body IMU 53, the hydraulic excavator 1 can calculate a position and an attitude of the body. Based on the result of measurement by the work implement IMU 51 (51*a*, 51*b*, 51*c*), the hydraulic excavator 1 can calculate a position and an attitude of the work device 1A. It should be noted that although the hydraulic excavator 1 of the present embodiment uses the IMU to acquire a position/attitude as an example, as long as a position/attitude can be detected/calculated, the aspect of the method for acquiring a position/displacement by an acquisition device does not matter, such as a rotary sensor, a potentiometer, a camera, a GNSS, a total station, and the like. Alternatively, the hydraulic excavator 1 may acquire a position/attitude via the server as an output from a detection device (e.g., a camera) disposed outside of the body, for example.

That is, the GNSS 52 and the upper turning body IMU 53 constitute a work machine position/attitude acquisition device 502 adapted to acquire a position and an attitude of the body in the present control system, and the work implement IMU 51 constitutes a work device position/attitude acquisition device 503 adapted to acquire a position and an attitude of the work device 1A in the present control system (FIG. 4).

Figure 2:
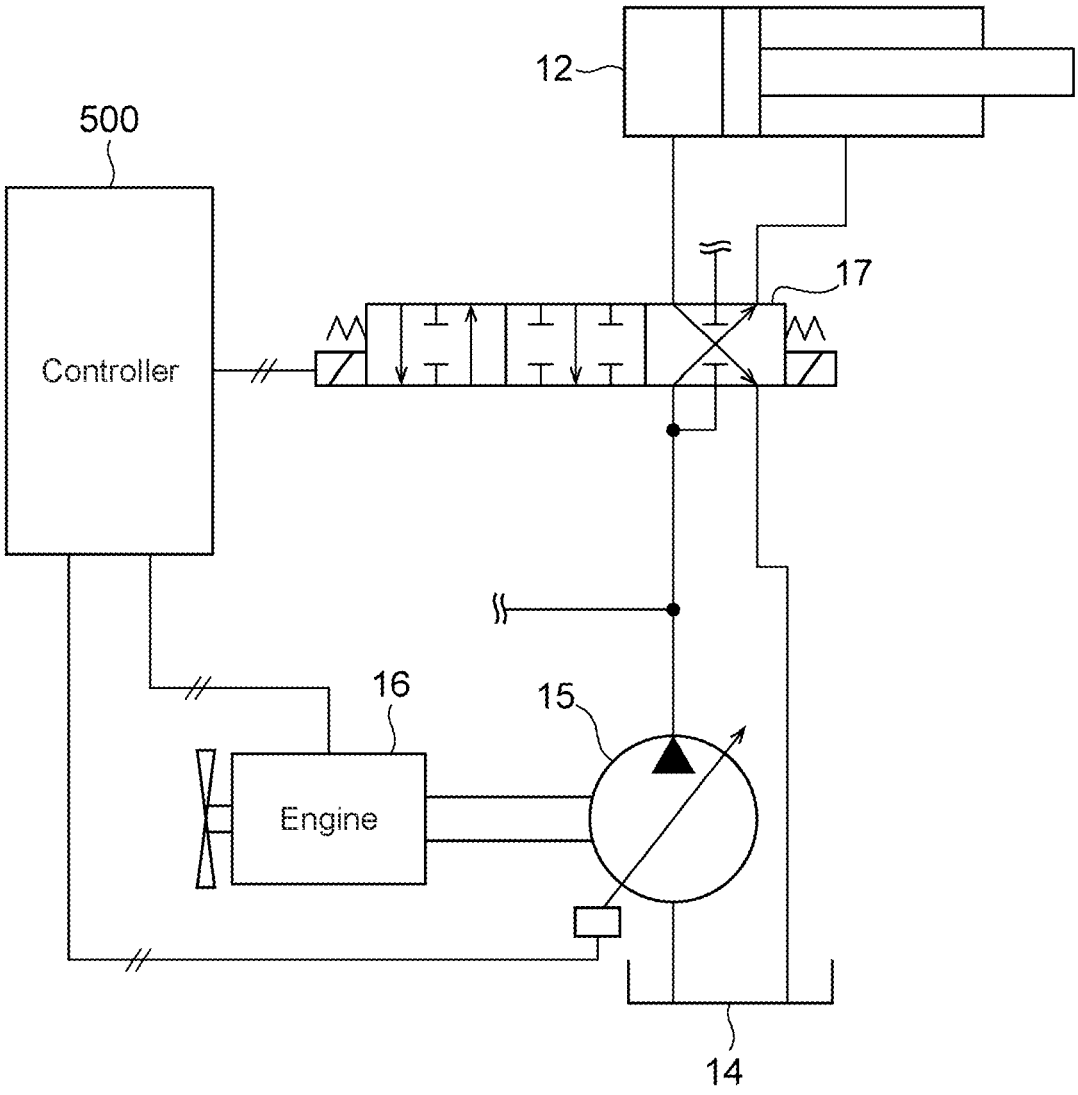
FIG. 2 is a circuit diagram of an example of a hydraulic circuit of the work machine according to the first embodiment of the present invention.

A hydraulic circuit of the hydraulic excavator 1 will be described. FIG. 2 illustrates an example of the hydraulic circuit of the hydraulic excavator 1.

The hydraulic circuit includes: an engine 16 for generating power; a tank 14 disposed at any given position on the upper turning body 1B; a variable pump 15 that is coupled to the engine 16 and converts, with the power of the engine 16, hydraulic oil in the tank 14 to pressure oil having any given pressure or flow rate; a flow rate control valve 17 that is coupled to the variable pump 15, the actuator 12, such as the boom cylinder 5, the arm cylinder 6, the bucket cylinder 7, the turning motor 11, and the travel motor 3, and the controller 500, and is capable of sending pressure oil of any given flow rate out of the pressure oil ejected from the variable pump 15 to the actuator 12; and the controller 500 adapted to control the flow rate of the flow rate control valve 17. By outputting a control instruction from the controller 500 for controlling the flow rate of the pressure oil that is sent from the flow rate control valve 17 to the actuator 12, it is possible to limit (i.e., decelerate and stop) the operation speed of the actuator 12, eventually, the operation speeds of the work device 1A and the moving device 1D.

It should be noted that the engine 16 is an example of a power generation device, and as long as power can be generated, the aspect thereof does not matter, such as an engine, a motor, or the like. In addition, as long as the flow rate of the flow rate control valve 17 can be controlled, an indirect control method in which a solenoid valve controls a pilot pressure of a hydraulic pilot type valve may be employed or a method in which a solenoid valve directly controls a flow rate may be employed.

Figure 3:
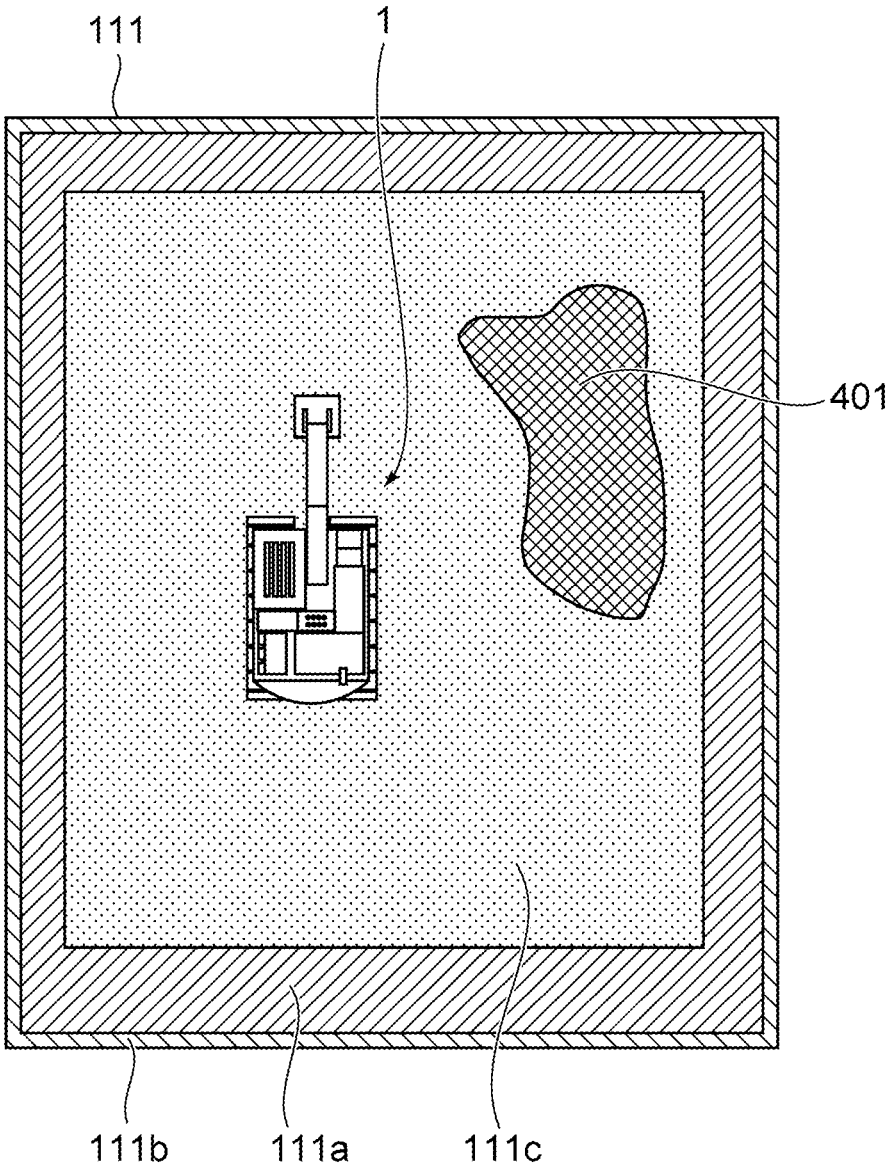
FIG. 3 is a top view of an example of a work area, a designated area, and a work machine according to the first embodiment of the present invention.

FIG. 3 is a top view of an example of a work area, a designated area, and a work machine according to the first embodiment of the present invention.

A work area 111 includes a deceleration area 111*a* in which the speed of either or both of the work device 1A or the moving device 1D of the hydraulic excavator 1 is limited, a stop area 111*b* in which the operation of either or both of the work device 1A or the moving device 1D of the hydraulic excavator 1 is stopped, and a non-restricted area 111*c* in which the speed and the operation of the work device 1A and the moving device 1D will not be restricted.

It should be noted that as long as the work area 111 is an area that puts any given rule to the actuator operation, the aspect thereof does not matter. In addition to the state of the first embodiment, in the work area 111, the operation of a designated actuator may be prohibited, or a work machine may be controlled to track a specific attitude, for example.

In addition, as long as the deceleration area 111*a*, the stop area 111*b*, and the non-restricted area 111*c* of the work area 111 are included inside of the work area 111, the work area 111 may have any three-dimensional shape and any division number (i.e., the number of divisions).

In addition, the present control system can switch between "the enabled state of the work area 111," in which the operation restriction control of the work device 1A and the moving device 1D in the work area 111 (111*a*, 111*b*, 111*c*) is enabled, and "the disabled state of the work area 111," in which the operation restriction control of the work device 1A and the moving device 1D in the work area 111 (111*a*, 111*b*, 111*c*) is disabled (described later).

A designated area 401 is any given space within a worksite and is used to set an enable/disable setting of the work area 111 (i.e., an enable/disable setting of the operation restriction control in the work area 111). The designated area 401 may be included inside of the work area 111 (FIG. 3) or outside of the work area 111.

(System Configuration)

FIG. 4 is a system configuration diagram of the present embodiment.

The control system of the present embodiment includes a work area setting device 501 capable of setting the work area 111 of any given three-dimensional or two-dimensional shape that is input via the interface 18, a work machine position/attitude acquisition device 502 adapted to measure/calculate a position/attitude of the body of the hydraulic excavator (work machine) 1 using the GNSS 52 and the upper turning body IMU 53, a work device position/attitude acquisition device 503 adapted to measure/calculate a position/attitude of the work device 1A using the work implement IMU 51, a designated area setting device 504 capable of setting the designated area 401 of any given three-dimensional or two-dimensional shape that is input via the interface 18, and a controller 500 adapted to perform calculations.

The controller 500 includes: a work area recording unit 505 adapted to record the work area 111 set in the work area setting device 501; a designated area recording unit 512 adapted to record the designated area 401 and the enable/disable setting of the work area 111 depending on the designated area 401 set in the designated area setting device 504; a work machine position/attitude calculation unit 509 adapted to calculate position/attitude data acquired from the work machine position/attitude acquisition device 502 and calculate the data in a format suitable for the data in a work area operation control unit 511 and a work area enable/disable determination unit 506 by coordinate transformation, for example; a work device position/attitude calculation unit 510 adapted to calculate position/attitude data acquired from the work device position/attitude acquisition device 503 and calculate the data in a format suitable for the data in the work area operation control unit 511 and the work area enable/disable determination unit 506 by coordinate transformation, for example; the work area enable/disable determination unit 506 adapted to determine an enable/disable setting of the work area 111 based on the attitudes calculated in the work machine position/attitude calculation unit 509 and the work device position/attitude calculation unit 510 and the information on the designated area 401 recorded in the designated area recording unit 512; and the work area operation control unit 511 adapted to determine an operation of the work device 1A and the moving device 1D of the hydraulic excavator 1 in the work area 111 based on the information on the work area 111 recorded in the work area recording unit 505, the attitude of the body calculated in the work machine position/attitude calculation unit 509, the attitude of the work device 1A calculated in the work device position/attitude calculation unit 510, and an enable/disable determination value received from the work area enable/disable determination unit 506.

In the controller 500, the work area enable/disable determination unit 506 repeats the determination of whether the position of the hydraulic excavator 1 is included in the designated area 401, and if the position of the hydraulic excavator 1 is included in the designated area 401, outputs, to the work area operation control unit 511, an enable/disable determination value by which the work area 111 is put to an enabled state or disabled state in accordance with the enable/disable setting of the work area 111 depending on the designated area 401 recorded in the designated area recording unit 512 (i.e., so as to match with the enable/disable setting of the work area 111 depending on the designated area 401).

The work area operation control unit 511 repeats the determination of whether the position of the hydraulic excavator 1 is included in the work area 111 (i.e., the deceleration area 111*a*, the stop area 111*b*, the non-restricted area 111*c*), and if the position of the hydraulic excavator 1 is included in the work area 111 (i.e., the deceleration area 111*a*, the stop area 111*b*, the non-restricted area 111*c*), outputs a control instruction to perform operation restriction control of the work device 1A and the moving device 1D of the hydraulic excavator 1. At this time, the work area operation control unit 511 puts (switches) the work area 111 to an enabled state or disabled state according to the enable/disable determination value (i.e., the enable/disable setting of the work area 111) received from the work area enable/disable determination unit 506, and when the work area 111 is in the enabled state, outputs a control instruction to perform operation restriction control of the work device 1A and the moving device 1D of the hydraulic excavator 1 as described above.

(Operation)

Figure 5:
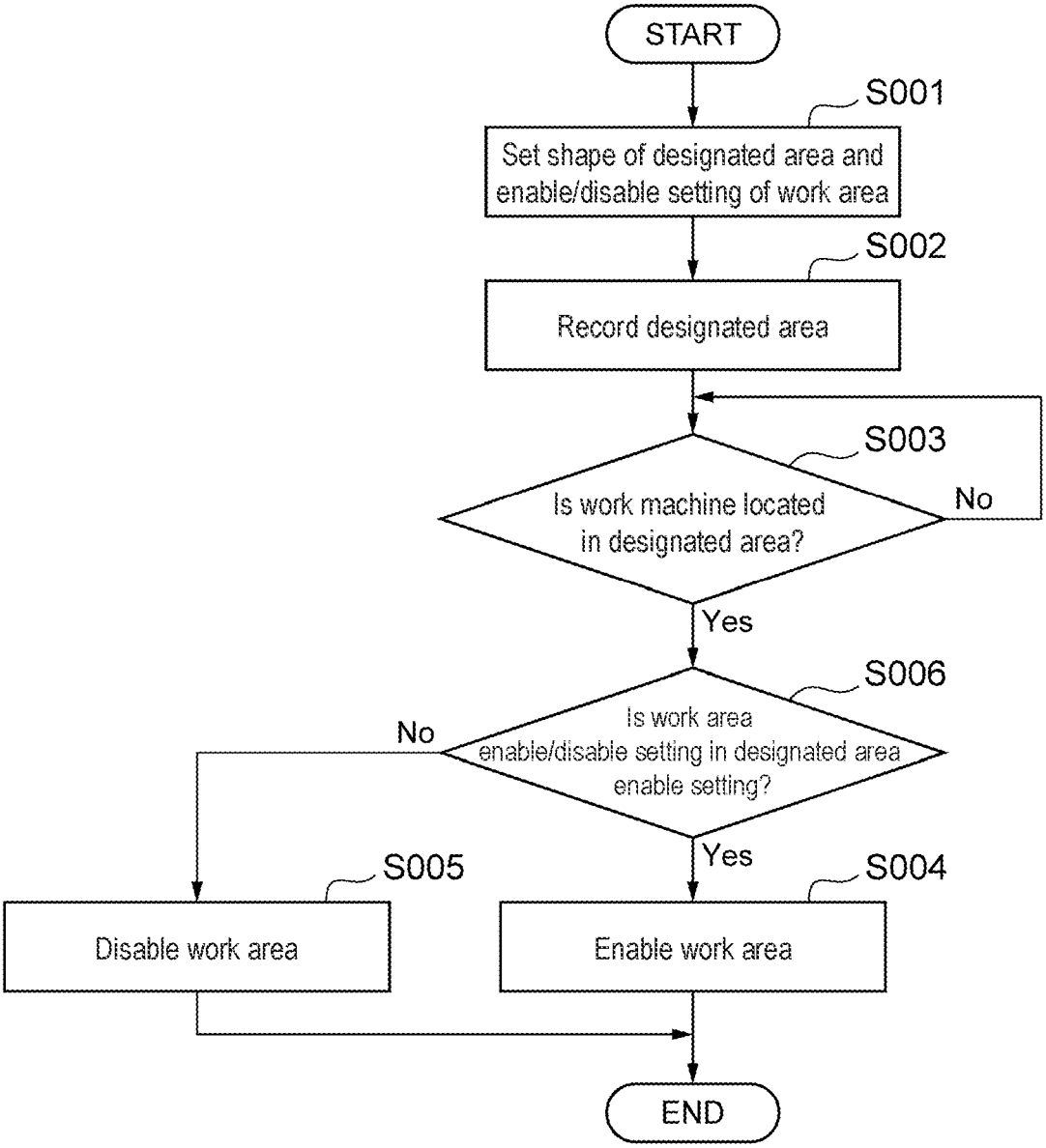
FIG. 5 is a flowchart of determining a work area enable/disable setting according to the first embodiment of the present invention.

FIG. 5 is an operating flow of determining an enable/disable setting of operation control in the work area 111 depending on the designated area 401.

First, an operator or the like sets a shape (i.e., spatial information) of the designated area 401 and an enable/disable setting of the work area 111 in the designated area setting device 504 via the interface 18 (S001). The shape of the designated area 401 and the enable/disable setting of the work area 111 set in the designated area setting device 504 are recorded in the designated area recording unit 512 (S002). The work area enable/disable determination unit 506 repeats the determination of whether the hydraulic excavator 1 is located in the designated area 401 using the designated area 401 recorded in the designated area recording unit 512 and the attitude of the body calculated in the work machine position/attitude calculation unit 509 (S003). If the hydraulic excavator 1 is located in the designated area 401 in S003 (S003: Yes), the work area enable/disable determination unit 506 determines a work area enable/disable setting recorded in the designated area recording unit 512 (S006). If the work area enable/disable setting is an enable setting in S006 (S006: Yes), the work area enable/disable determination unit 506 outputs an enable/disable determination value by which the work area 111 is put to an enabled state (S004), and if the work area enable/disable setting is a disable setting in S006 (S006: No), the work area enable/disable determination unit 506 outputs an enable/disable determination value by which the work area is put to a disabled state (S005).

Figure 6:
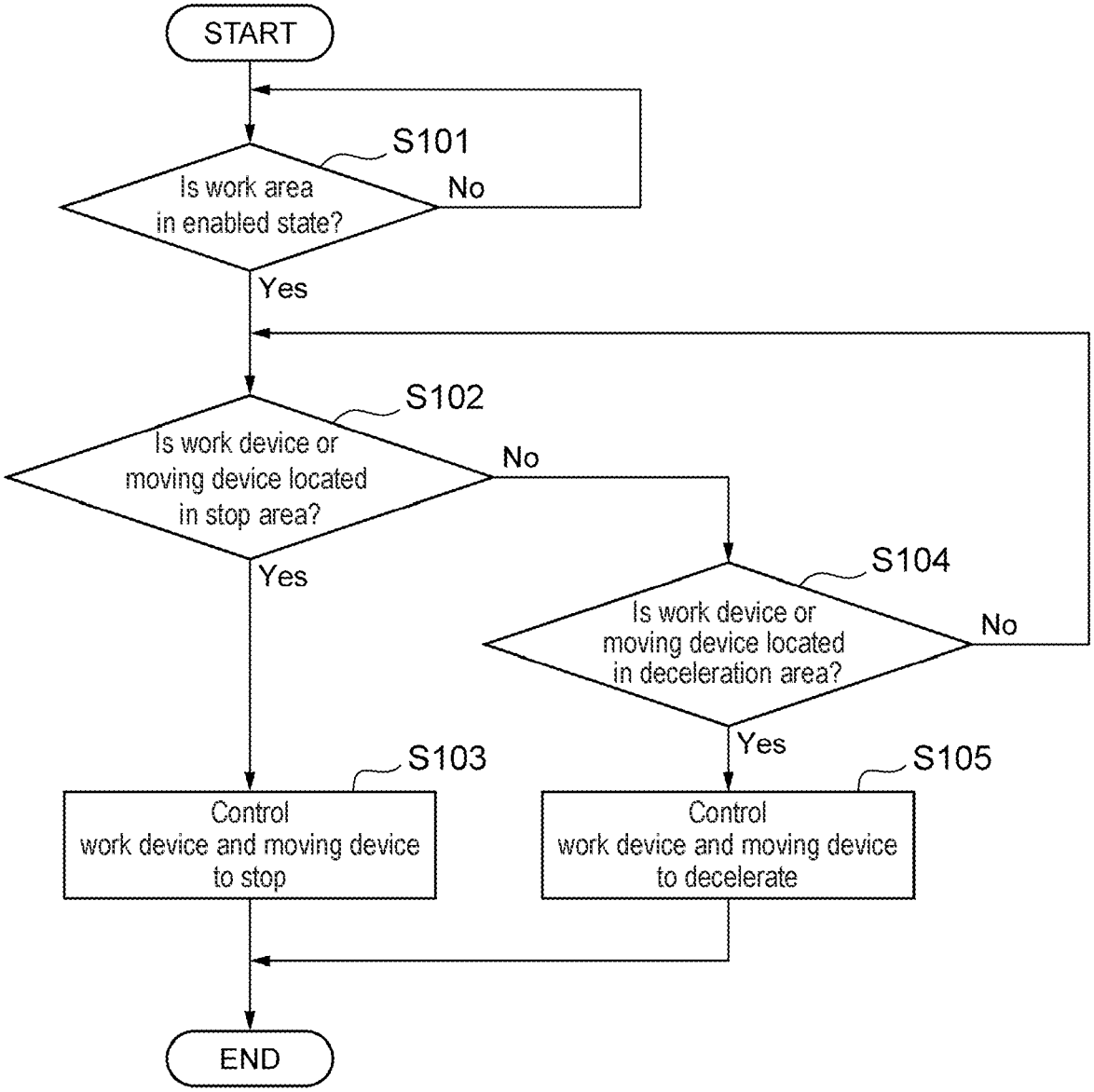
FIG. 6 is a flowchart of controlling the operation in a work area according to the first embodiment of the present invention.

FIG. 6 is a flow of the operation control in the work area 111.

First, the work area operation control unit 511 determines whether the work area 111 is in an enabled state or disabled state in response to the enable/disable determination value (the flow of FIG. 5) received from the work area enable/disable determination unit 506 (S101). If the work area 111 is in the enabled state in S101 (S101: Yes), the work area operation control unit 511 determines whether the work device 1A or the moving device 1D is located in the stop area 111*b* (S102). If the work device 1A or the moving device 1D is located in the stop area 111*b* in S102 (S102: Yes), the work area operation control unit 511 outputs a control instruction to stop the work device 1A and the moving device 1D (S103). In contrast, if the work device 1A and the moving device 1D are located outside of the stop area 111*b* in S102 (S102: No), the work area operation control unit 511 determines whether the work device 1A or the moving device 1D is located in the deceleration area 111*a* (S104). If the work device 1A or the moving device 1D is located in the deceleration area 111*a* in S104 (S104: Yes), the work area operation control unit 511 outputs a control instruction to control the work device 1A and the moving device 1D to decelerate (S105). In contrast, if the work device 1A and the moving device 1D are located outside of the deceleration area 111*a* in S104 (S104: No), the process returns to S102 again and repeats the determination.

It should be noted that although deceleration and stop are shown as the examples of the operation control in the work area 111, as long as the operation control conforms to a specific rule, such as stopping a designated actuator or restricting a specific attitude in the work area 111, or the like, a content thereof does not matter. Thus, it is also considered that the stop area or the deceleration area shown as a fixed area in one example may be variable according to the current state of the work machine.

In addition, in the present embodiment, although the controller 500 mounted on the hydraulic excavator (work machine) 1 determines an enable/disable setting of the work area 111 and calculates a control instruction for the work device 1A and the moving device 1D based on the information output from the work area setting device 501, the work machine position/attitude acquisition device 502, the work device position/attitude acquisition device 503, and the designated area setting device 504, a server (or a controller installed thereon) may determine an enable/disable setting, calculate a control instruction, and transmit the control instruction to the hydraulic excavator 1.

Advantageous Effect of the First Embodiment

As described above, the hydraulic excavator 1 of the first embodiment includes: the work area setting device 501 adapted to set the work area 111 for performing operation restriction control of the hydraulic excavator (work machine) 1; the acquisition device (i.e., the work machine position/attitude acquisition device 502, the work device position/attitude acquisition device 503) adapted to acquire at least one of a position or an attitude of the hydraulic excavator (work machine) 1; the controller 500 adapted to switch between an enabled state, in which the operation restriction control of the hydraulic excavator (work machine) 1 in the work area 111 is enabled, and a disabled state, in which the operation restriction control of the hydraulic excavator (work machine) 1 in the work area 111 is disabled and, when the operation restriction control is switched to the enabled state, perform the operation restriction control of the hydraulic excavator (work machine) 1 in the work area 111; and the designated area setting device 504 adapted to set any given designated area 401 in a worksite and an enable or disable setting of the operation restriction control in the work area 111 depending on the designated area 401. When the hydraulic excavator (work machine) 1 intrudes on the designated area 401, the controller 500 puts the operation restriction control in the work area 111 to an enabled state or disabled state in accordance with the enable or disable setting of the operation restriction control depending on the designated area 401 set in the designated area setting device 504.

Specific examples of the operation of the hydraulic excavator (work machine) 1 include as follows: an operator or the like, at any given point, sets a "designated area 401," which is any given space in a worksite, "whether the designated area 401 serves to enable or disable the work area 111," and a "work area 111" (i.e., the designated area setting device 504, the work area setting device 501); after such setting, the operator or the like moves the hydraulic excavator 1 at an appropriate timing. When the hydraulic excavator 1 has entered the designated area 401, the present control system enables or disables the work area 111 according to the preliminary settings (i.e., the work area enable/disable determination unit 506 and the work area operation control unit 511 of the controller 500).

According to the first embodiment, it is possible to separately provide any given designated area 401 for switching the enable/disable setting in the work area 111, make settings of the work area 111 at any position regardless of whether the hydraulic excavator 1 is inside or outside of the work area 111 in setting the work area 111, and prevent the hydraulic excavator 1 from being stopped within the work area 111, thus improving the work efficiency.

Second Embodiment (System Configuration)

Figure 7:
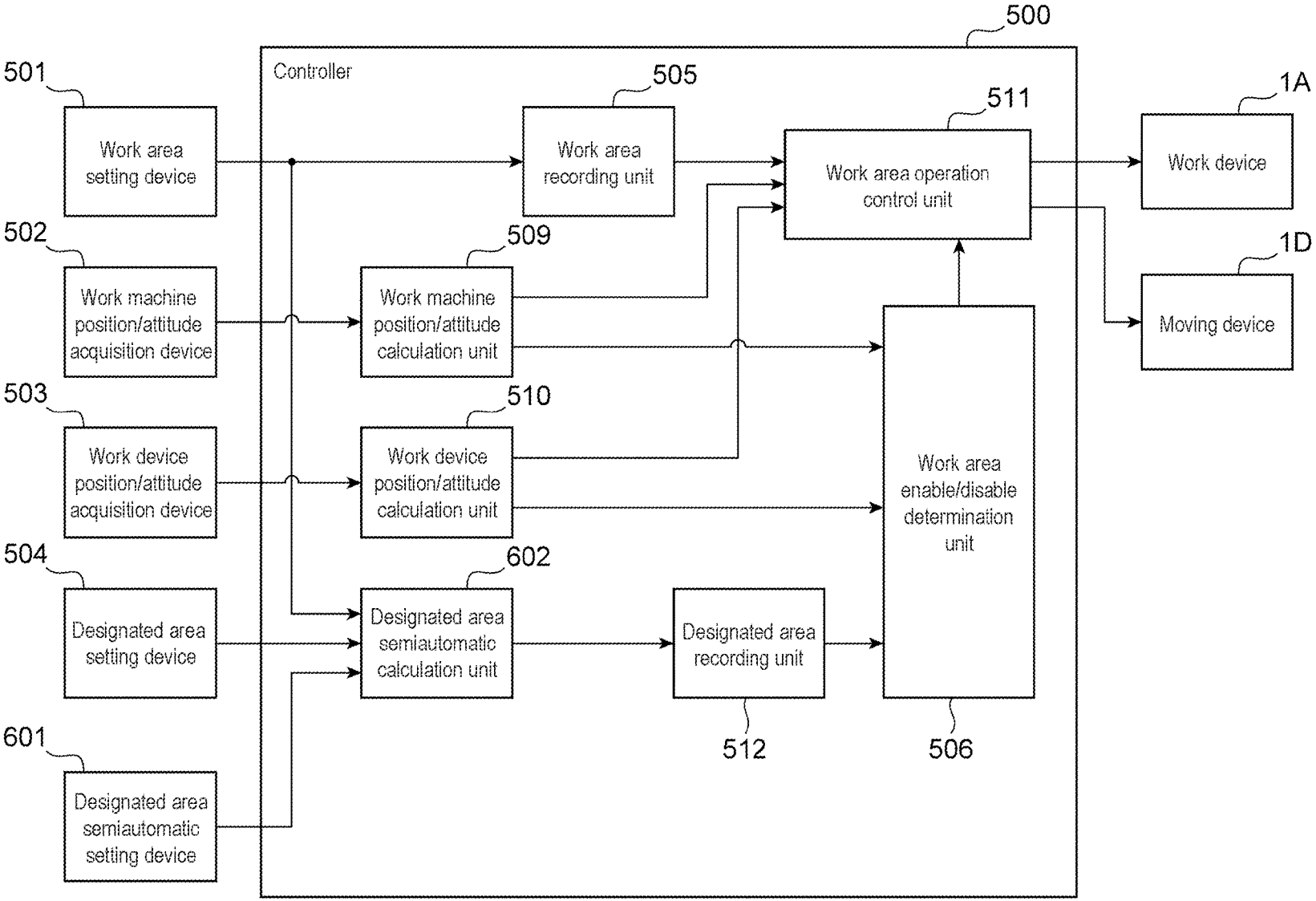
FIG. 7 is a system configuration diagram according to a second embodiment of the present invention.

FIG. 7 is a system configuration diagram of the present embodiment.

In addition to the configuration of the first embodiment, the control system of the present embodiment includes a designated area semiautomatic setting device 601 adapted to set whether an operator uses the work area 111 for a designated area 401 (in other words, whether to set a designated area 401 matching with the work area 111). The designated area semiautomatic setting device 601 may be disposed in the interface 18 or outside of the interface 18. It should be noted that this setting may be performed by an operator or a worker around the hydraulic excavator, for example, and the aspect of inputting does not matter. Alternatively, this inputting/setting may be performed from the outside of the body via a server, for example.

In addition to the configuration of the first embodiment, the controller 500 includes a designated area semiautomatic calculation unit 602 adapted to calculate a designated area 401 using spatial information (i.e., coordinate points and shape) on the work area 111 set in the work area setting device 501, spatial information (i.e., coordinate points and shape) on the designated area 401 set in the designated area setting device 504, and information on whether to use the work area 111 that is set in the designated area semiautomatic setting device 601.

The designated area semiautomatic calculation unit 602 mainly determines whether there is an area setting (i.e., a designated area setting for using the work area) in the designated area semiautomatic setting device 601 and, if there is an area setting, sets a designated area 401 according to the shape of the work area 111 set in the work area setting device 501 (herein, so as to match with the shape of the work area 111). In addition, when there is no area setting, the designated area semiautomatic calculation unit 602 sets a designated area 401 based on the shape of the designated area 401 set in the designated area setting device 504.

(Operation)

Figure 8:
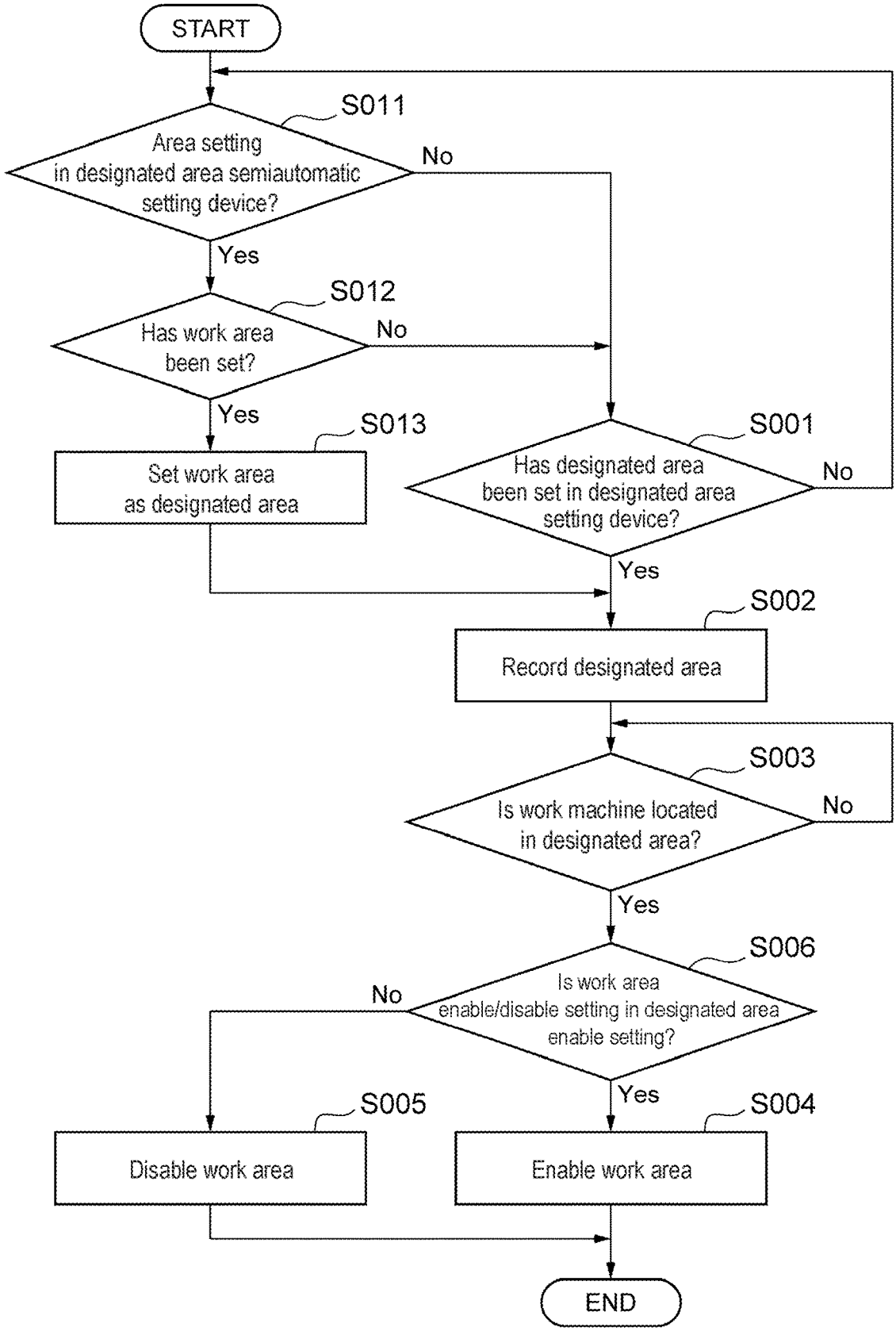
FIG. 8 is a flowchart of determining a work area enable/disable setting according to the second embodiment of the present invention.

FIG. 8 is an operating flow of determining an enable/disable setting of operation control in the work area 111 depending on the designated area 401 of the present embodiment.

First, the designated area semiautomatic calculation unit 602 determines whether an operator or the like has set an area setting in the designated area semiautomatic setting device 601 (S011). If a designated area has already been set in S011 (S011: Yes), the designated area semiautomatic calculation unit 602 determines whether a work area 111 has already been set in the work area setting device 501 (S012). If a work area 111 has already been set in S012 (S012: Yes), the work area 111 is set as the designated area 401 (S013), and recorded in the designated area recording unit 512 (S002). If a designated area has not been set in S011 (S011: No) or a work area 111 has not been set in S012 (S012: No), the designated area semiautomatic calculation unit 602 determines whether a designated area 401 has already been set in the designated area setting device 504 (S001). If a designated area 401 has already been set in S001 (S001: Yes), the area set in the designated area setting device 504 is recorded as the designated area 401 in the designated area recording unit 512 (S002). If a designated area 401 has not been set in S001 (S001: No), the process returns to the determination in S011 again. The operation in S002 and afterward is equal to that of the first embodiment (see FIG. 5).

The operation control in the work area 111 is equal to that of the first embodiment (see FIG. 6).

Figure 9:
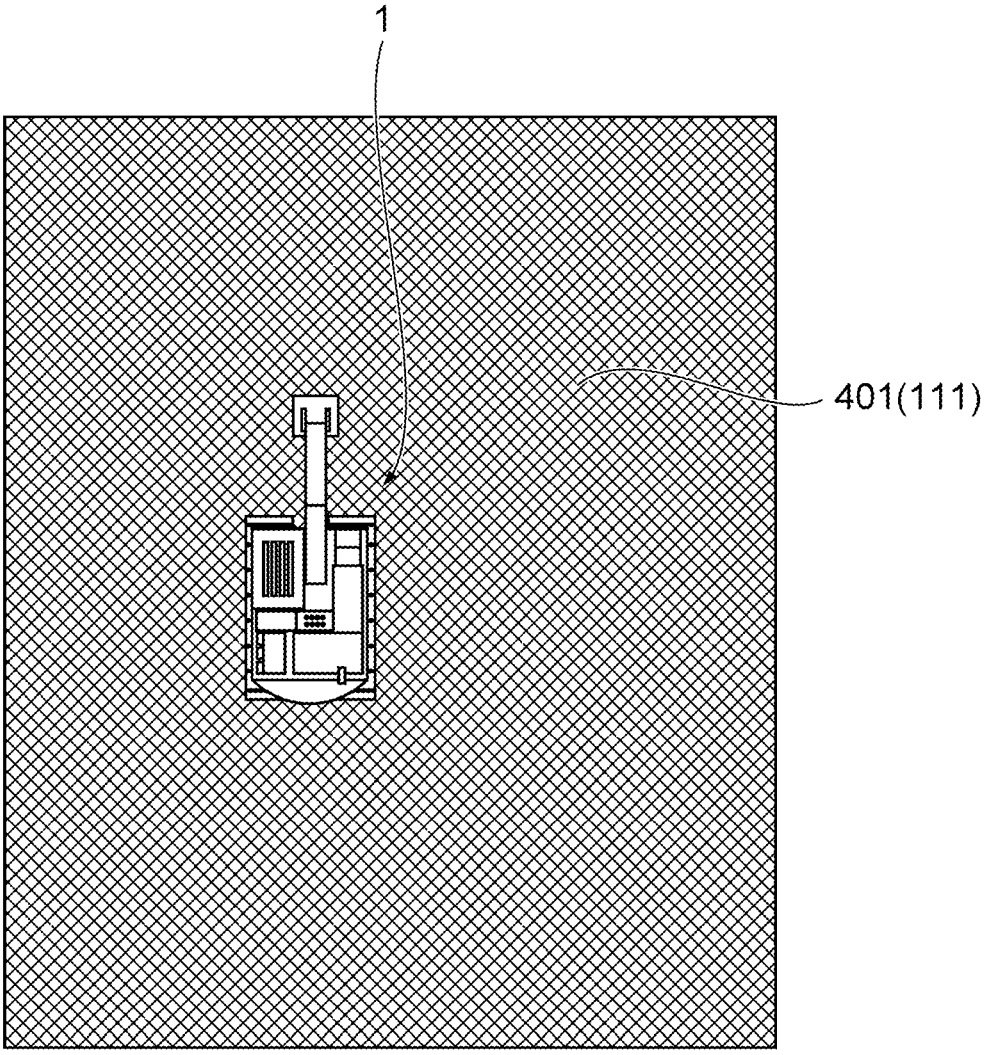
FIG. 9 is a top view of an example of a work area, a designated area, and a work machine according to the second embodiment of the present invention.

By applying the present embodiment to FIG. 3, FIG. 9 illustrates an example in which the designated area 401 is now identical to the work area 111.

Advantageous Effect of the Second Embodiment

As described above, the hydraulic excavator 1 of the second embodiment includes the designated area semiautomatic setting device 601 adapted to set a designated area 401 according to the shape of the work area 111 (herein, so as to match with the shape of the work area 111).

According to the second embodiment, in addition to the advantageous effect of the first embodiment, it is possible to easily set a designated area 401 when setting a designated area 401 matching with the work area 111, and reduce the operator's work of setting a designated area 401.

Third Embodiment (System Configuration)

The control system of the present embodiment is equal to that of the second embodiment. However, the designated area semiautomatic calculation unit 602 mainly determines whether there is an area setting in the designated area semiautomatic setting device 601 and, if there is an area setting, sets a designated area 401 according to the shape of the work area 111 set in the work area setting device 501 (herein, so that the shape of the designated area 401 is in an exclusive relation with the shape of the work area 111). It should be noted that the exclusive relation can, for example, prevent reentry into the work area 111 after the hydraulic excavator 1 in the work area 111 finishes working in the work area 111 and then moves outside of the work area 111. Specifically, by providing a designated area 401 outside of the work area 111, the hydraulic excavator 1 outside of the work area 111 is located in the designated area 401, whereby the operation restriction control is enabled and the entry into the work area 111 can be prevented.

(Operation)

Figure 10:
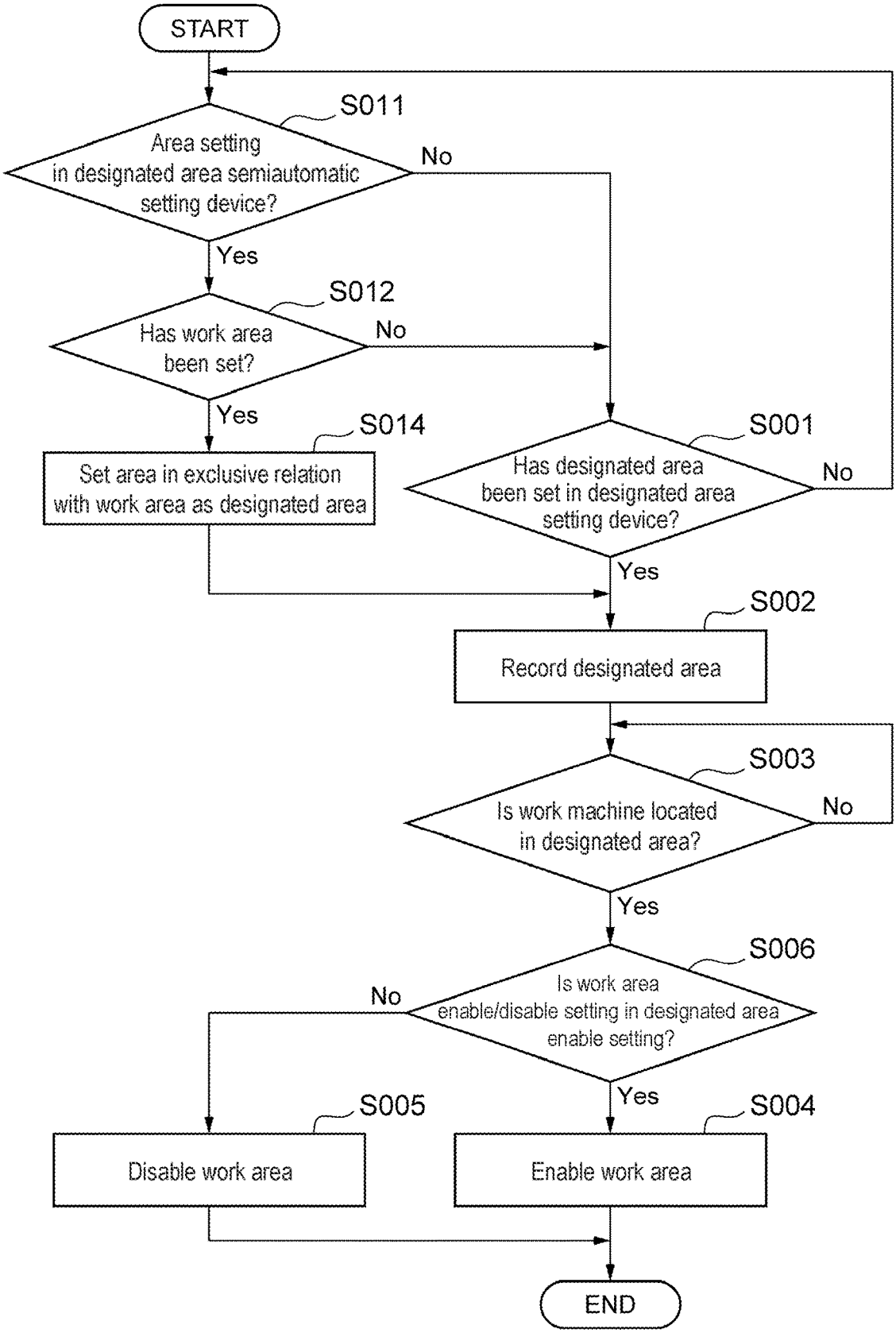
FIG. 10 is a flowchart of determining a work area enable/disable setting according to a third embodiment of the present invention.

FIG. 10 is an operating flow of determining an enable/disable setting of operation control in the work area 111 depending on the designated area 401 of the present embodiment.

Instead of S013 of the second embodiment, if a work area 111 has already been set in S012 (S012: Yes), the area in an exclusive relation with the work area 111 is set as the designated area 401 (S014), and recorded in the designated area recording unit 512 (S002).

Figure 11:
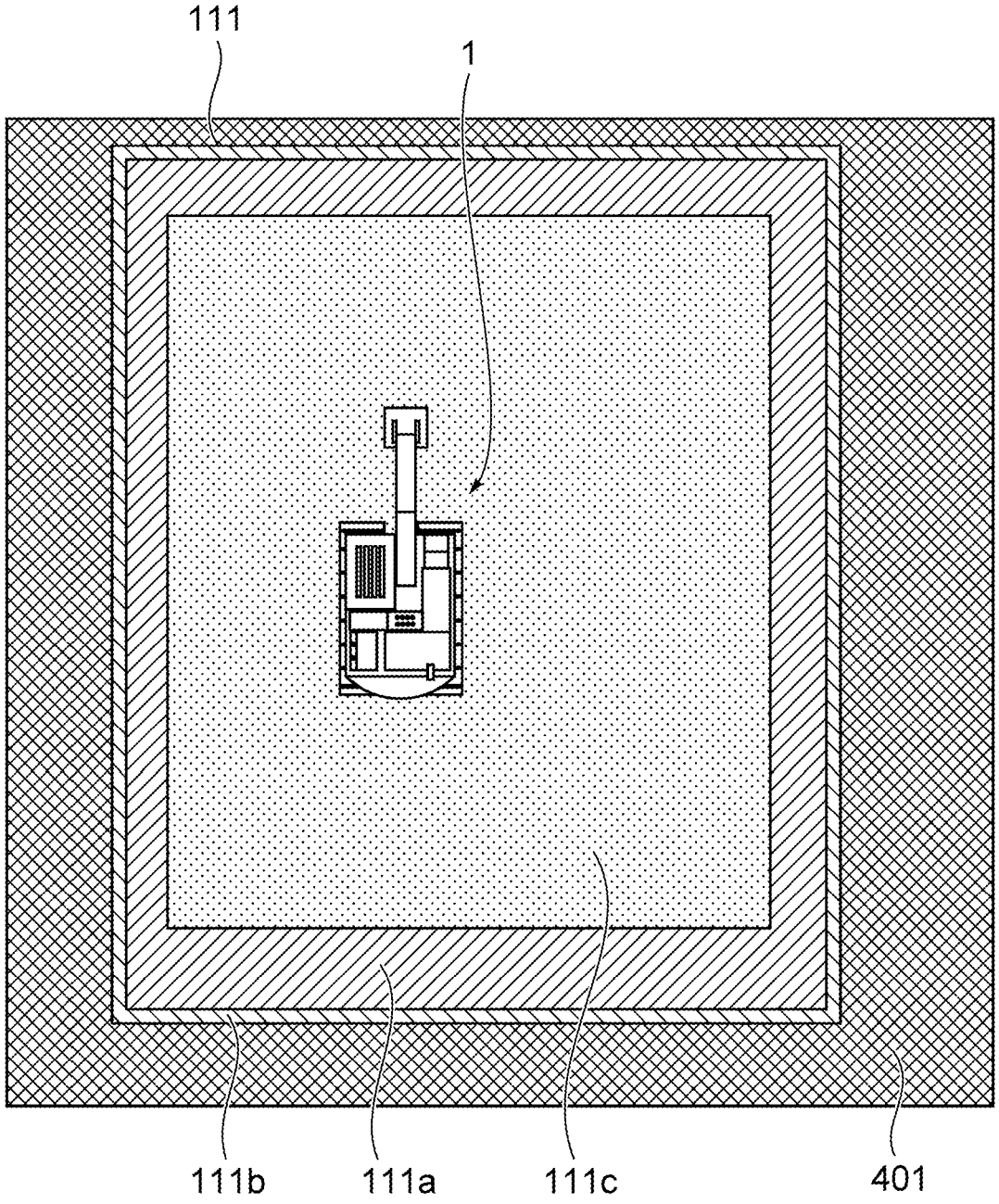
FIG. 11 is a top view of an example of a work area, a designated area, and a work machine according to the third embodiment of the present invention.

By applying the present embodiment to FIG. 3, FIG. 11 illustrates an example in which the designated area 401 is now in an exclusive relation with the work area 111 (i.e., an example in which the designated area 401 is set outside of the work area 111).

Advantageous Effect of the Third Embodiment

As described above, the hydraulic excavator 1 of the third embodiment includes the designated area semiautomatic setting device 601 adapted to set a designated area 401 according to the shape of the work area 111 (herein, so that the shape of the designated area 401 is in an exclusive relation with the shape of the work area 111).

According to the third embodiment, in addition to the advantageous effect of the first embodiment, it is possible to easily set a designated area 401 when setting a designated area 401 in an exclusive relation with the work area 111 having a complicated shape, and reduce the operator's work of setting a designated area 401.

Fourth Embodiment (System Configuration)

Figure 12:
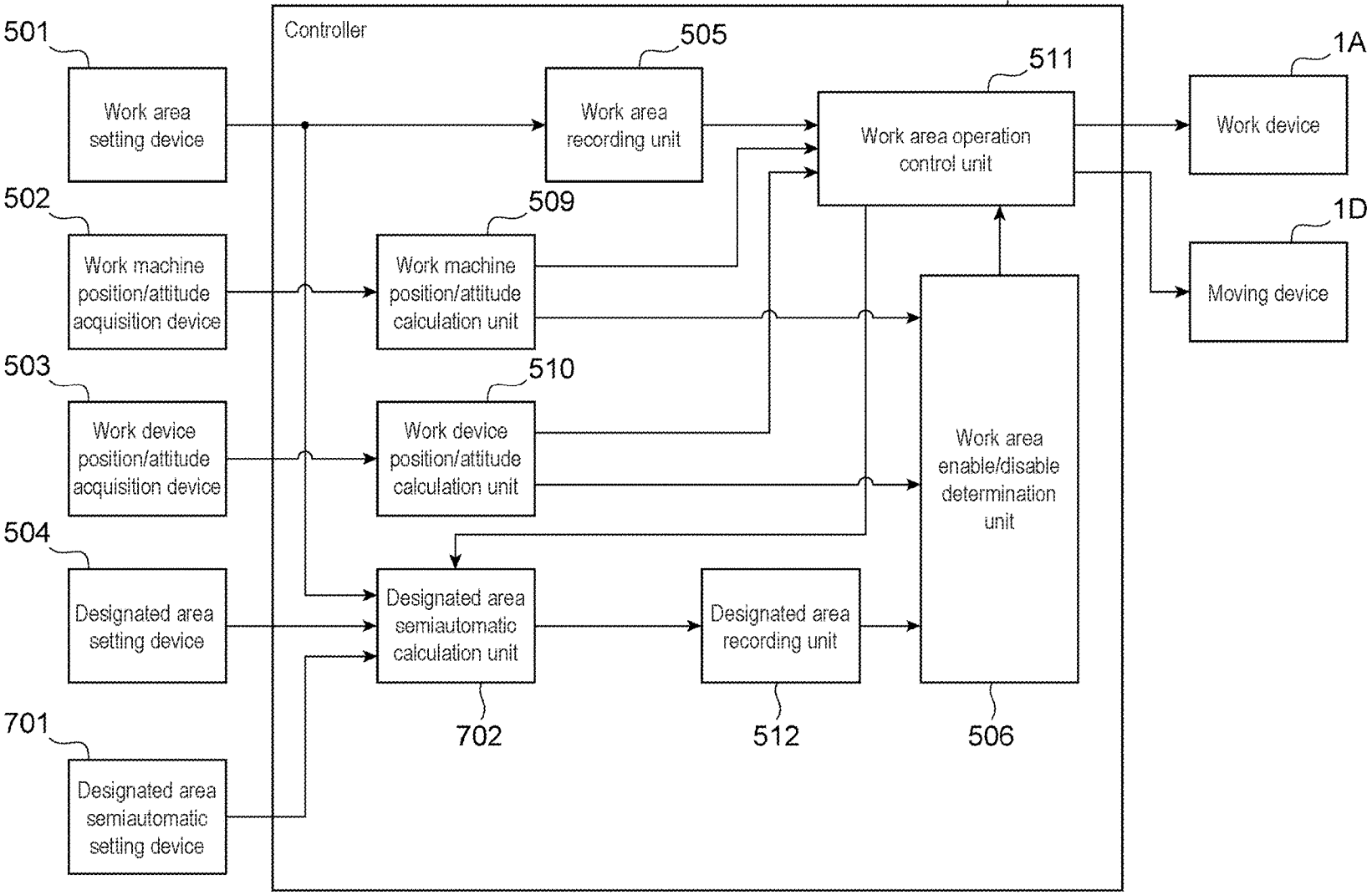
FIG. 12 is a system configuration diagram according to a fourth embodiment of the present invention.

FIG. 12 is a system configuration diagram of the present embodiment.

In addition to the configuration of the first embodiment, the control system of the present embodiment includes a designated area semiautomatic setting device 701 adapted to set whether an operator incorporates the actuator operation in the work area 111 designated in the work area operation control unit 511 into a designated area 401 (in other words, whether to set a designated area 401 matching with the non-restricted area 111*c* in the work area 111). The designated area semiautomatic setting device 701 may be disposed in the interface 18 or outside of the interface 18. It should be noted that this setting may be performed by an operator or a worker around the hydraulic excavator, for example, and the aspect of inputting does not matter. Alternatively, this inputting/setting may be performed from the outside of the body via a server, for example.

In addition to the configuration of the first embodiment, the controller 500 includes a designated area semiautomatic calculation unit 702 adapted to calculate a designated area 401 using the actuator operation in the work area 111 designated in the work area operation control unit 511, spatial information on the work area 111 set in the work area setting device 501, spatial information on the designated area 401 set in the designated area setting device 504, and information on whether to incorporate the actuator operation in the work area 111 designated in the work area operation control unit 511 that is set in the designated area semiautomatic setting device 701.

The designated area semiautomatic calculation unit 702 mainly determines whether there is an area setting (i.e., a designated area setting for incorporating the actuator operation in the work area 111) in the designated area semiautomatic setting device 701 and, if there is an area setting, sets a designated area 401 according to the operation control content in the work area 111 (herein, so as to match with the shape of the non-restricted area 111*c* in the work area 111).

(Operation)

Figure 13:
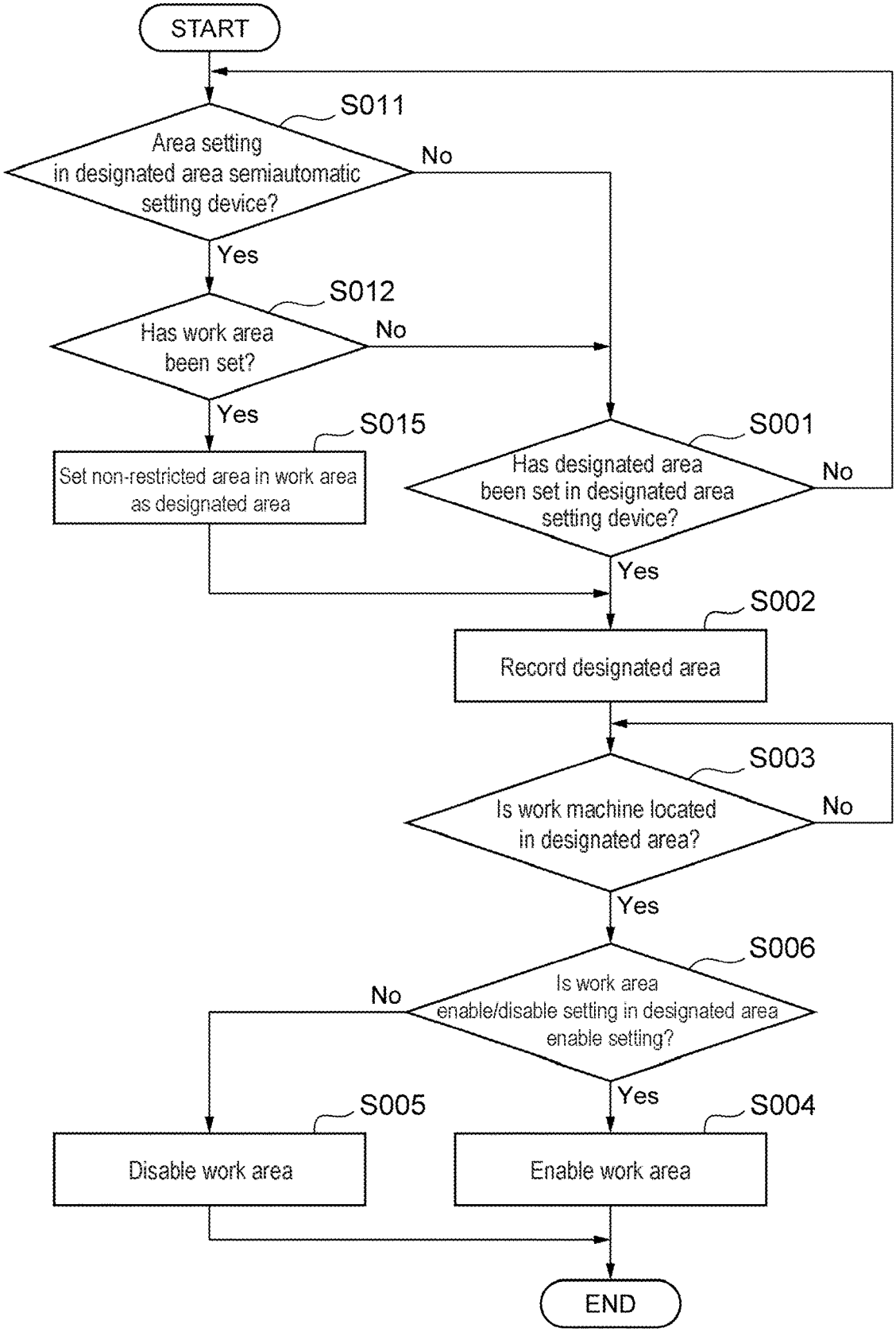
FIG. 13 is a flowchart of determining a work area enable/disable setting according to the fourth embodiment of the present invention.

FIG. 13 is an operating flow of determining an enable/disable setting of operation control in the work area 111 depending on the designated area 401 of the fourth embodiment.

Instead of S013 of the second embodiment, if a work area 111 has already been set in S012 (S012: Yes), the non-restricted area 111*c* in the work area 111 is set as the designated area 401 (S015), and recorded in the designated area recording unit 512 (S002).

Figure 14:
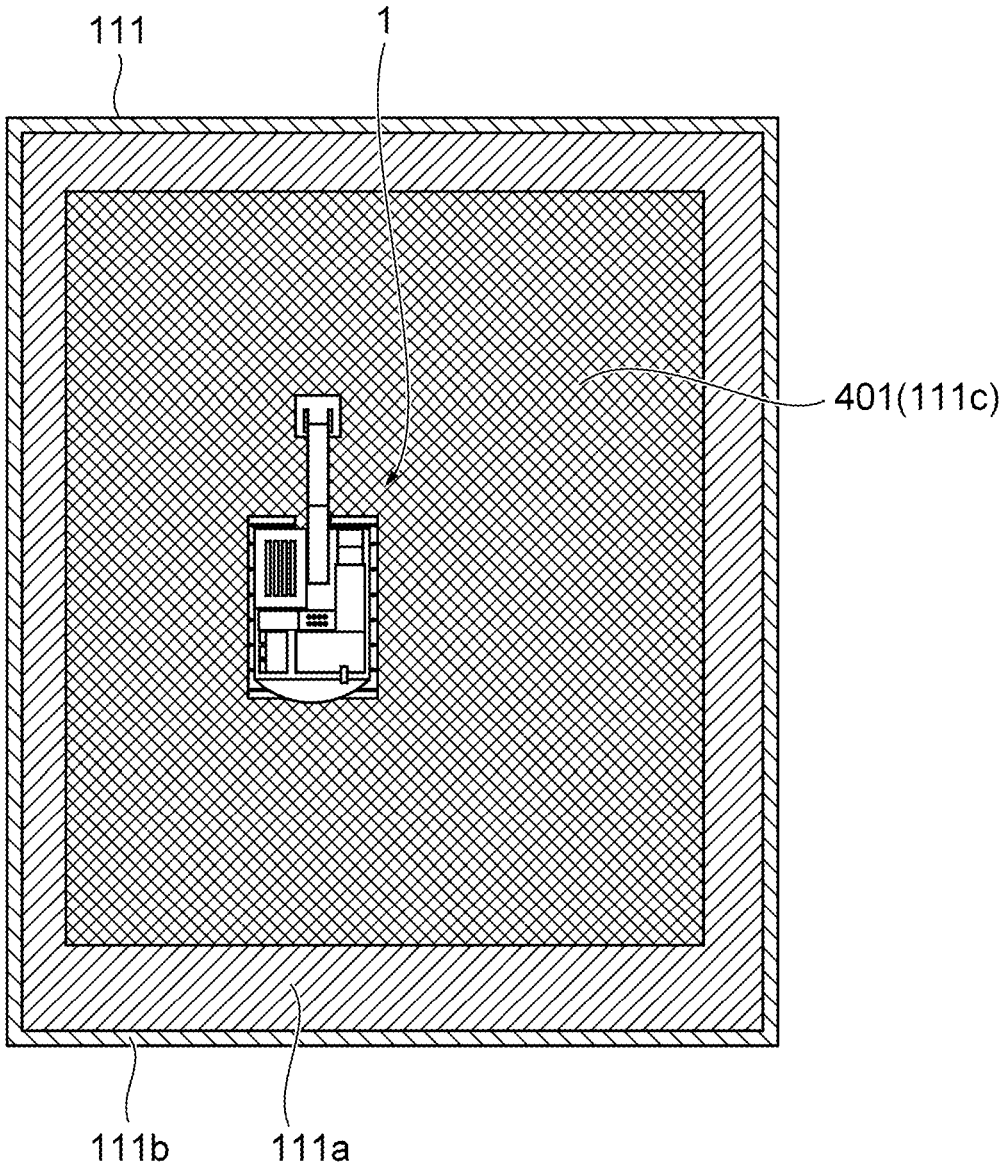
FIG. 14 is a top view of an example of a work area, a designated area, and a work machine according to the fourth embodiment of the present invention.

By applying the present embodiment to FIG. 3, FIG. 14 illustrates an example in which the designated area 401 is now equal to (i.e., matching with) the non-restricted area 111*c* in the work area 111.

Advantageous Effect of the Fourth Embodiment

As described above, the hydraulic excavator 1 of the fourth embodiment includes the designated area semiautomatic setting device 701 adapted to set a designated area 401 according to the operation control content in the work area 111 (herein, so as to match with the shape of the non-restricted area 111*c* in the work area 111).

According to the fourth embodiment, in addition to the advantageous effect of the first embodiment, it is possible to easily set a designated area 401, within the work area 111 having a complicated shape, when setting a designated area 401 having the same shape as the non-restricted area 111*c* in which the operation of the hydraulic excavator (work machine) 1 will not be restricted, and reduce the operator's work of setting a designated area 401.

Fifth Embodiment (Overall Configurations)

Figure 15:
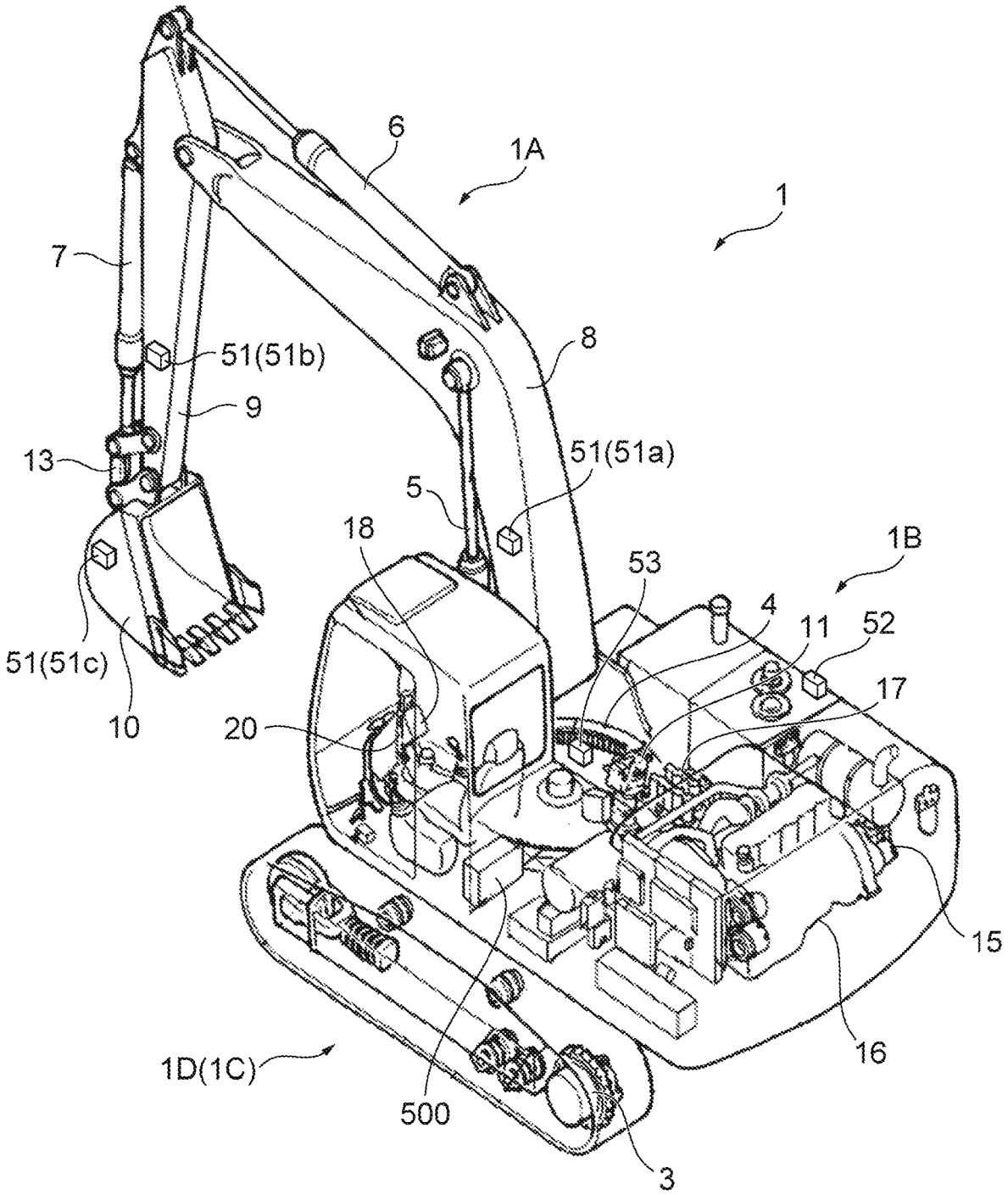
FIG. 15 is a perspective view of an example of a work machine according to a fifth embodiment of the present invention.

FIG. 15 illustrates a hydraulic excavator that is an example of a work machine using the present embodiment.

In addition to the configuration of the first embodiment, the hydraulic excavator 1 of the present embodiment includes a display device 20 adapted to display the work area 111 and the designated area 401. It should be noted that the display device 20 may be disposed in a server that has control over the hydraulic excavator 1.

(Operation)

Figure 16:
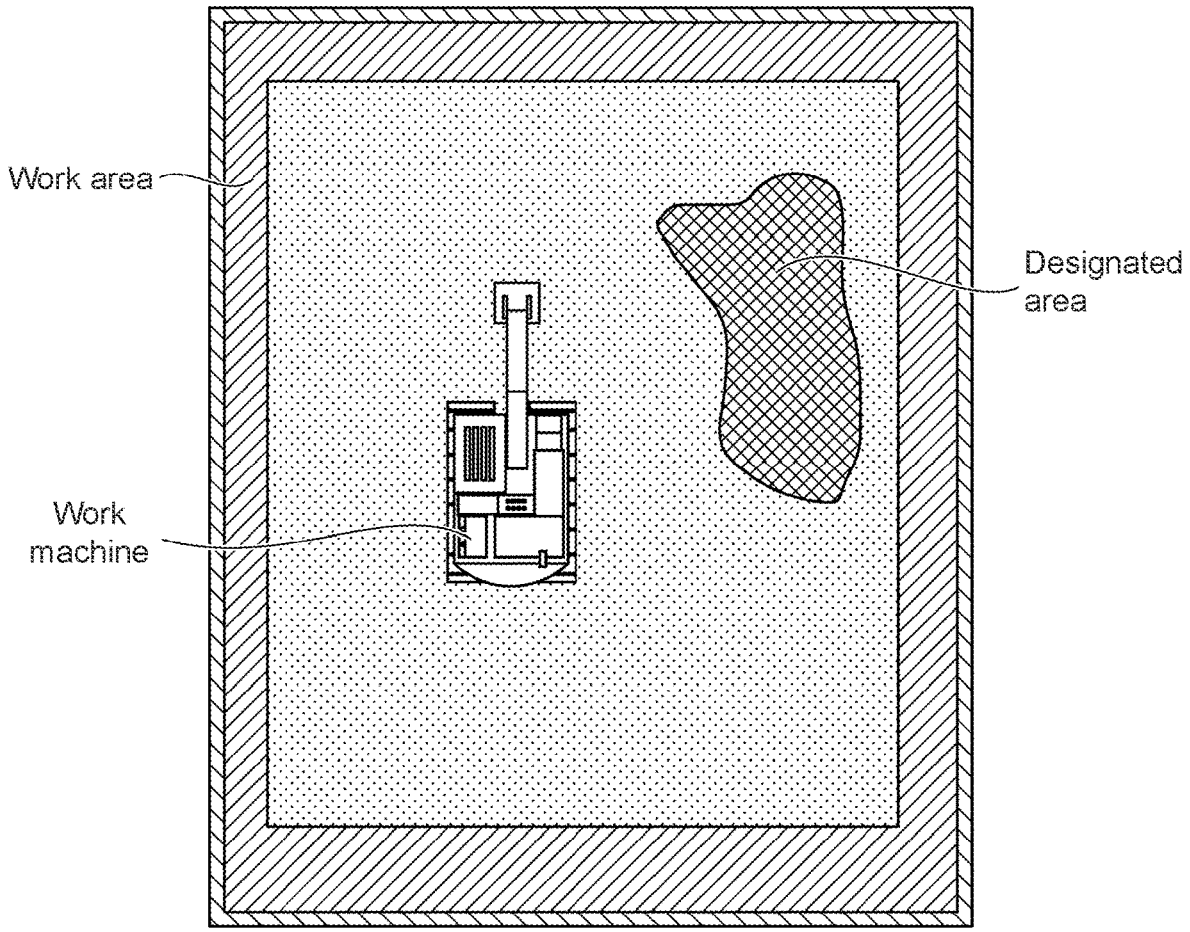
FIG. 16 illustrates an example of a display screen of a display device according to the fifth embodiment of the present invention.

FIG. 16 illustrates an example of a display screen of the display device 20.

In the display device 20, the designated area 401, the work area 111, the enable/disable setting of the work area 111, and the hydraulic excavator (work machine) 1 are represented in overhead view or three-dimensional view on the same screen, and different patterns or different colors are displayed so that the designated area 401, the work area 111, and the enable/disable setting of the work area 111 are apparently distinguishable.

Advantageous Effect of the Fifth Embodiment

As described above, the hydraulic excavator 1 of the fifth embodiment includes the display device 20 adapted to simultaneously display the designated area 401, the work area 111, and the enabled state or disabled state of the operation restriction control in the work area 111.

According to the fifth embodiment, in addition to the advantageous effect of the first embodiment, the operator can easily confirm the designated area 401, the work area 111, and the enable/disable setting of the work area 111, thus improving the work efficiency.

It should be noted that the present invention is not limited to the aforementioned embodiments, and includes a variety of modifications. The aforementioned embodiments have been described in detail to clearly illustrate the present invention, and the present invention need not include all of the structures described in the embodiments.

In addition, some or all of the aforementioned functions of the controller of the embodiments may be implemented as hardware by designing them into an integrated circuit, for example. Alternatively, each of the functions may be implemented as software such that a processor analyzes and executes a program that implements each function. Information such as the program that implements each function, tables, and files can be stored in a recording device such as a hard disk or a SSD (Solid State Drive) or a recording medium such as an IC card, an SD card, or a DVD, other than the storage unit in the controller.

REFERENCE SIGNS LIST

1 Hydraulic excavator (work machine)
1A Work device
1B Upper turning body

1C Lower traveling body
1D Moving device
18 Interface
20 Display device (fifth embodiment)
51 Work implement IMU
52 GNSS
53 Upper turning body IMU
111 Work area
111*a* Deceleration area
111*b* Stop area
111*c* Non-restricted area
401 Designated area
500 Controller
501 Work area setting device
502 Work machine position/attitude acquisition device
503 Work device position/attitude acquisition device
504 Designated area setting device
505 Work area recording unit
506 Work area enable/disable determination unit
509 Work machine position/attitude calculation unit
510 Work device position/attitude calculation unit
511 Work area operation control unit
512 Designated area recording unit
601 Designated area semiautomatic setting device (second embodiment)
602 Designated area semiautomatic calculation unit (second embodiment)
701 Designated area semiautomatic setting device (fourth embodiment)
702 Designated area semiautomatic calculation unit (fourth embodiment)

The invention claimed is:

1. A work machine comprising:

a work area setting device adapted to set a work area for performing operation restriction control of a work machine;

an acquisition device adapted to acquire at least one of a position or an attitude of the work machine;

a controller adapted to switch between an enabled state, in which the operation restriction control of the work machine in the work area is enabled, and a disabled state, in which the operation restriction control of the work machine in the work area is disabled, and, when the operation restriction control is switched to the enabled state, perform the operation restriction control of the work machine in the work area; and a designated area setting device adapted to set any given designated area in a worksite and set a relationship between whether the position of the work machine is included in the designated area and the enabled state or disabled state of the operation restriction control in the work area, wherein the operation restriction control in the work area performs deceleration or stopping of an operation of the work machine when the work machine is included in a deceleration area or a stop area provided in the work area, and wherein when the work machine moves and the position thereof is included in the designated area, the controller puts the operation restriction control in the work area to an enabled state or disabled state according to a setting of the relationship between whether the position of the work machine is included in the designated area and the enabled state or disabled state of the operation restriction control in the work area set in the designated area setting device.

2. The work machine according to claim 1, further comprising a designated area semiautomatic setting device adapted to set the designated area according to a shape of the work area.

3. The work machine according to claim 1, further comprising a designated area semiautomatic setting device adapted to set the designated area so as to match with the work area or outside of the work area.

4. The work machine according to claim 1, further comprising a designated area semiautomatic setting device adapted to set the designated area according to an operation control content in the work area.

5. The work machine according to claim 1, further comprising a display device adapted to simultaneously display the designated area, the work area, and an enabled state or disabled state of the operation restriction control in the work area.

6. A control system for a work machine, comprising:

a work area setting device adapted to set a work area for performing operation control of a work machine; and an acquisition device adapted to acquire at least one of a position or an attitude of the work machine, wherein the control system for the work machine is adapted to switch between an enabled state, in which operation restriction control of the work machine in the work area is enabled, and a disabled state, in which the operation restriction control of the work machine in the work area is disabled, and, when the operation restriction control is switched to the enabled state, perform the operation restriction control of the work machine in the work area, the control system for the work machine further comprising:

a designated area setting device adapted to set any given designated area in a worksite and, set a relationship between whether the position of the work machine is included in the designated area and the enabled state or disabled state of the operation restriction control in the work area, wherein the operation restriction control in the work area performs deceleration or stopping of an operation of the work machine when the work machine is included in a deceleration area or a stop area provided in the work area, and when the work machine moves and the position thereof is included in the designated area, the control system for the work machine puts the operation restriction control in the work area to an enabled state or disabled state according to a setting of the relationship between whether the position of the work machine is included in the designated area and the enabled state or disabled state of the operation restriction control in the work area set in the designated area setting device.

* * * * *